US008267161B2

(12) United States Patent
Knaus et al.

(10) Patent No.: US 8,267,161 B2
(45) Date of Patent: Sep. 18, 2012

(54) FIN FOR A HEAT EXCHANGER AND MANUFACTURING METHOD

(75) Inventors: Hermann Knaus, Stuttgart (DE); Florian Schmidt, Remseck (DE); Werner Oswald, Horb (DE); Jens Paulik, Korntal-Münchingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 638 days.

(21) Appl. No.: 12/247,822

(22) Filed: Oct. 8, 2008

(65) Prior Publication Data

US 2009/0090497 A1 Apr. 9, 2009

(30) Foreign Application Priority Data

Oct. 8, 2007 (DE) ..... 10 2007 048 307

(51) Int. Cl.
*F23D 1/02* (2006.01)

(52) U.S. Cl. ..... 165/152

(58) Field of Classification Search ..... 165/185, 165/109.1, 151, 152, 153
See application file for complete search history.

(56) References Cited

U.S. PATENT DOCUMENTS

| | | | | |
|---|---|---|---|---|
| 3,584,682 | A | 6/1971 | Leedham et al. | |
| 4,501,321 | A * | 2/1985 | Real et al. | 165/153 |
| 5,669,438 | A * | 9/1997 | Beales et al. | 165/152 |
| 2007/0193730 | A1* | 8/2007 | Ozaki | 165/140 |

FOREIGN PATENT DOCUMENTS

| | | |
|---|---|---|
| DE | 1 937 122 | 1/1970 |
| DE | 0152 187 | 11/1981 |
| DE | 195 11 665 A1 | 10/1996 |

OTHER PUBLICATIONS

L. Stewart Rolls et al., "Test of a small-scale NACA submerged inlet at transonic mach numbers", National Advisory Committee for Aeronautics Research Memorandum A9L29, Washington, D.D. Feb. 23, 1950.*

L. Stewart Rolls et al., "Test of a small-scale NACA submerged inlet at transonic mach numbers", National Advisory Committee for Aeronautics Research Memorandum A9L29, Washington, D.C. Feb. 23, 1950.

* cited by examiner

*Primary Examiner* — Henry Yuen
*Assistant Examiner* — Devon Russell
(74) *Attorney, Agent, or Firm* — Foley & Lardner LLP

(57) ABSTRACT

The invention relates to a fin for a heat exchanger, comprising a fin element which extends in the flow direction of a first fluid and has a wall face around which the first fluid flows on both sides, wherein at least one flap is provided in the wall face, which flap forms a cutout, through which the first fluid can flow, in the wall face, wherein a first edge of the flap for forming the cutout is arranged spaced apart from the wall face, wherein the flap has a tab face which is inclined with respect to the wall face and terminates at the first edge, wherein the tab face is connected to the wall face via at least one side wall, extending with a curved profile, of the flap, which side wall, starting at the first edge, has a height which decreases in a way which corresponds to the inclination of the tab face.

18 Claims, 3 Drawing Sheets

FIN FOR A HEAT EXCHANGER AND MANUFACTURING METHOD

CROSS-REFERENCE TO RELATED PATENT APPLICATIONS

The right of foreign priority is claimed under 35 U.S.C. §119(a) based on Federal Republic of Germany Application No. 10 2007 048 307.6, filed Oct. 8, 2007, the entire contents of which, including the specification, drawings, claims and abstract, are incorporated herein by reference.

BACKGROUND

The invention relates to a fin for a heat exchanger as claimed in the preamble of Claim 1 and to a heat exchanger having such a fin. The invention also relates to a fin for a heat exchanger as claimed in the preamble of claim 14 and to a method for manufacturing a fin for a heat exchanger.

Heat exchangers are known in which, in order to improve the exchanging performance, the fins are provided in ducts through which fluid flows. Such fins can be embodied, for example, as smooth fins, gill fins or else as web fins. In the first case, owing to the largely laminar flow, only a relatively small improvement in the exchanging performance is achieved but the drop in pressure of the fluid which is brought about by the fins is also relatively small. Web fins exhibit a particularly clear improvement in the exchanging performance for a given structural size, but also give rise to an often undesirably large drop in pressure across the flow duct. Web fins are used, inter alia, in charge air coolers of motor vehicles, predominantly on the charge air side.

DD 0 152 187 describes a strip-shaped tubular installation element for tubular bundle heat exchangers in the field of the petrochemical industry, in which trapezoidal flaps for generating turbulence are provided. The flaps have a variable width in the flow direction, with the flaps being bent out of the strip by an angle of more than 30° about a longer edge of two parallel edges of the trapezoid.

The research report ("Research Memorandum") number RM A9L29 of the National Advisory Committee for Aeronautics (NACA), Washington, USA, of Feb. 23, 1950, describes a countersunk air inlet for aerofoil whose flow behavior was examined in a velocity range from Mach 0.6 to Mach 1.08.

SUMMARY OF PREFERRED EMBODIMENTS

The object of the invention is to specify a fin for a heat exchanger which has good thermal exchange properties for a given drop in pressure. In addition, the object of the invention is to specify a fin for a heat exchanger which can be manufactured cost-effectively with a high level of efficiency.

This object is achieved according to the invention for a device of the type mentioned at the beginning by means of the defining features of Claim 1. By virtue of the at least one side wall, with a curved profile, of the flap which, starting at the first edge, has a height which decreases in a way which corresponds to the inclination of the tab face, improved flow of the air in the region of the flap is achieved, as a result of which a greater quantity of heat is exchanged between the air and the fin for a given drop in pressure.

In one preferred embodiment of the invention, the first edge forms at least an end-side edge of the at least one side wall, and a second edge of the wall face forms an opening which is oriented essentially perpendicularly with respect to the flow direction and through which the first fluid can flow, said opening having particularly preferably an essentially triangular shape. The tab face is connected here to the wall face via a third edge, wherein the tab face is preferably bent with respect to the wall face by means of the third edge, and the angle is advantageously between approximately eight degrees and approximately sixteen degrees, in particular approximately twelve degrees. The length of the third edge is here advantageously between approximately twice and approximately four times, in particular approximately three times, the length of the first edge. Overall, this makes available a scoop-shaped flap with a particularly small drop in pressure with good exchange of heat of the air flowing through, as has been shown by trials.

In the preferred embodiment, the flaps can also be reliably manufactured in series production for the case of a thin-walled fin on an aluminium basis. A fin according to the invention can be composed of aluminum or of steel or of some other material which is suitable depending on the requirements.

In a particularly preferred detail configuration, the shape of the tab face has, starting from the first edge, approximately the parameterization [0; 2.500], [0.805; 2.470], [1.610; 2.290], [2.420; 1.910], [3.220; 1.540], [4.030; 1.210], [4.840; 0.980], [5.640; 0.780], [6.440; 0.590], [7.240; 0.400], [8.050; 0.210], wherein the first value respectively specifies the distance from the first edge in the flow direction, and the second value respectively specifies the distance of the side wall from the third edge. Such shaping corresponds, in a plan view of the tab face, approximately to what is referred to as an NACA air inlet which is divided in half along its central axis, according to the search report number RM A9L29 mentioned at the beginning.

The invention generally provides in an advantageous way that a width of the tab face decreases as the distance from the first edge increases, with the result that a nozzle effect for air which flows along the flap is produced.

Furthermore, the curvature of the at least one side wall has, in its profile, at least one turning point with respect to the direction of curvature, as a result of which particularly good modulation of the air flow in order to improve the exchange of heat accompanied by a small drop in pressure is achieved.

In one optimized embodiment of the invention, the inclination of the tab face with respect to the wall face in the flow direction is between approximately five degrees and approximately ten degrees, in particular approximately seven degrees.

In one advantageous development, the fin has a plurality of flaps in succession in the flow direction, which, in particular in the case of long fins, results in an appropriate arrangement for the purpose of multiple deflection of the air over the fin section. Otherwise, the air flow would advantageously only be influenced by the flap over part of the fin. It is particularly preferred here that at least one of the plurality of flaps is arranged with a reversed orientation, wherein in particular an overall effect of the flaps on the fluid stream is largely independent of its direction. As a result, for example the fin can be installed with both orientations without effects.

In an alternative or supplementary embodiment, in order to optimize the air flow further there is provision that at least two flaps with different opening directions with respect to the wall face are provided in the wall face.

At least two flaps with different opening directions or positioning directions with respect to the wall face are furthermore advantageously provided in the wall face. Such an alternating arrangement of the opening direction of the flaps makes it possible for the exchange of heat with the flowing air to take place particularly uniformly over both sides of the fin.

The object of the invention is achieved for a fin according to the preamble of Claim 14 by means of the defining features of Claim 14. By means of the at least slight inclination of the wall face which is provided with the structure it is technically possible to manufacture such a fin in a particularly easy way. In particular, especially easy manufacture is ensured here if the structure in the wall face does not produce any significant undercuts owing to the inclination of the wall face, viewed in the perpendicular direction with respect to the plane. For example, this permits the fin to be manufactured by means of a longitudinal rolling method.

In a preferred detail configuration of such a fin there is provision that the angle W3 is not less than approximately 10°, in particular between approximately 15° and approximately 20°. In these value ranges, the angle of inclination of the wall permits, on the one hand, sufficiently large and/or deep structures in the wall face in order to influence the flow of the fluid in a desired way and, on the other hand, the wall face is still sufficiently rigid for the sake of mechanical strength. For example, the wall face can form a tie between the walls of a flat tube which is under high fluid pressure, for example if the fin is used as an internally corrugated fin of a charge air cooler.

In one particularly preferred embodiment of the invention, the fin is manufactured as a quasi-endless shaped part from a sheet metal strip by means of longitudinal rolling in the flow direction A. By longitudinal rolling, the fin can be shaped in a particularly cost-effective way with a high fabrication speed. In this context, the fold in the wall faces of the fin and the structures in the wall faces can be manufactured at the same time. A quasi-endless fin can also easily be cut to the length of particularly large heat exchangers. This avoids the need to plug a plurality of individual fins into an exchanger tube in order to provide the latter with fins over the entire length.

In one preferred embodiment, the fin is composed of sheet metal with a thickness between approximately 0.05 mm and approximately 0.35 mm, in particular between approximately 0.1 mm and approximately 0.15 mm. The material is expediently an aluminum alloy here, in which case it is also particularly possible to roll the fin longitudinally as a manufacturing method owing to the ease of shaping the aluminum in conjunction with the selected sheet metal thicknesses.

The structure can generally advantageously be embodied as a stamped and/or indented and/or offset portion in the wall face. In this context, offsets in the wall face are particularly effective on the flow of the first fluid, with the result that the fluid can partially pass through the wall face into an adjacent flow space.

In one possible detail configuration, the fin has, in addition to the wall face which is inclined by the angle W3, a wall face which is essentially perpendicular with respect to the plane. These wall faces can, in particular, alternate. The perpendicular wall faces provide particularly good mechanical rigidity of the fin here so as to resist tensile forces and compressive forces. For the sake of ease of manufacture, a structure is preferably not provided in the wall face which is perpendicular with respect to the plane. However, depending on the requirements it is also possible for all the wall faces to be inclined, and in particular to be provided with structures.

In one particularly preferred embodiment, the fin is embodied as an internally corrugated fin of a charge air cooler. Structured wall faces in contrast to conventional smooth fins are favorable for high power density charge air coolers.

The object of the invention is achieved for a manufacturing method. The quasi-endless manufacture of the fin by means of longitudinal rolling in the feeding direction of the sheet metal strip provides a cost-effective process for large-scale manufacture. In addition, fins of a particularly large length can also be produced, with the result that, for example in the case of an internally corrugated fin of an exchanger tube, only a single fin has to be inserted into the exchanger tube.

For the sake of optimizing the manufacturing method, there is provision that the number of rollers which are arranged in succession is at least 10, in particular at least 15. As a result of the large number of separate rolling steps, the shaping of the sheet metal strip can be carried out in a precise and distinctive way at the same time. In this case it is possible, for example, for the angle of the inclination of the wall faces to be relatively small. In addition, particularly complex structures such as, for example, broken-through offsets or flaps can be provided in the wall faces.

In a preferred detail configuration of the manufacturing method according to the invention, the fin is embodied as described herein.

The invention also relates to a heat exchanger having at least one fin. The heat exchanger is preferably a heat exchanger for a motor vehicle, in particular a heat exchanger from the group comprising coolant coolers, air-conditioning heat exchangers or charge air coolers. In particular in motor vehicles, and in particular in passenger cars, there is an increasing lack of installation space, with the result that the transmission power of a heat exchanger in relation to its overall size is highly significant. Configuring the fins of the heat exchanger according to the invention allows the exchanging performance to be improved with the same overall size.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

Figure 1A:
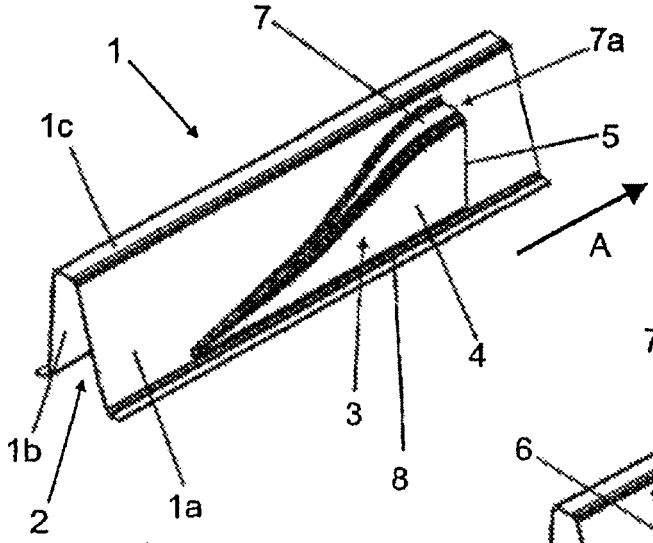
FIGS. 1(*a*)-(*d*) show a spatial illustration of the four refinements a-d of an exemplary embodiment of a fin according to the invention, FIG. 1(*e*) schematically shows an embodiment in which a plurality of flaps in succession are on the same fin.
Figure 1B:
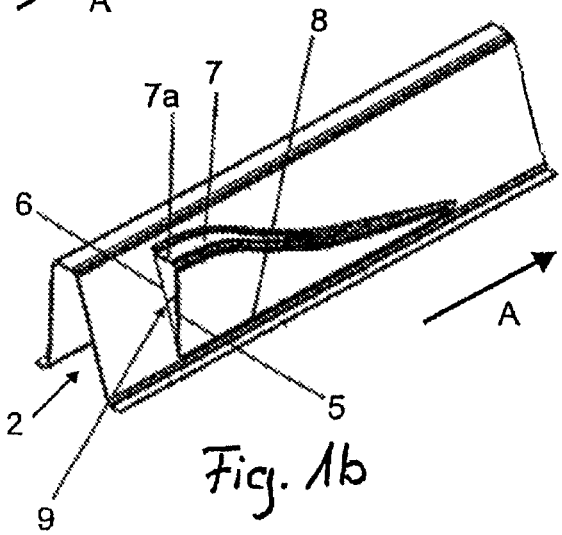
Figure 1C:
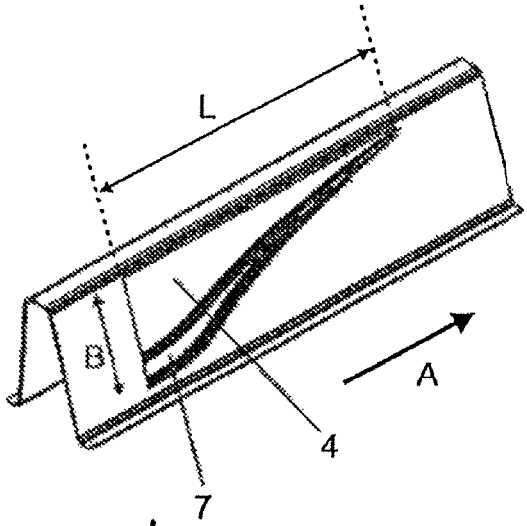
Figure 1D:
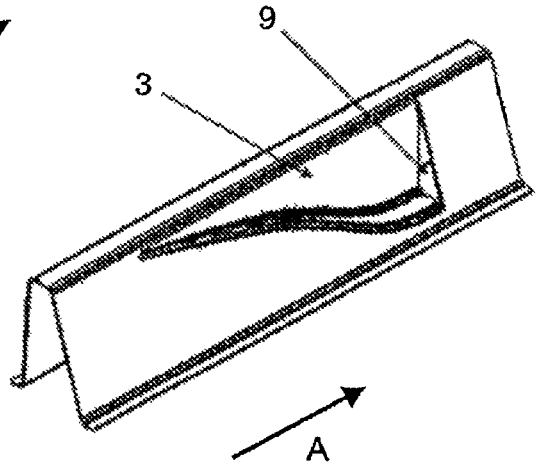
Figure 1E:
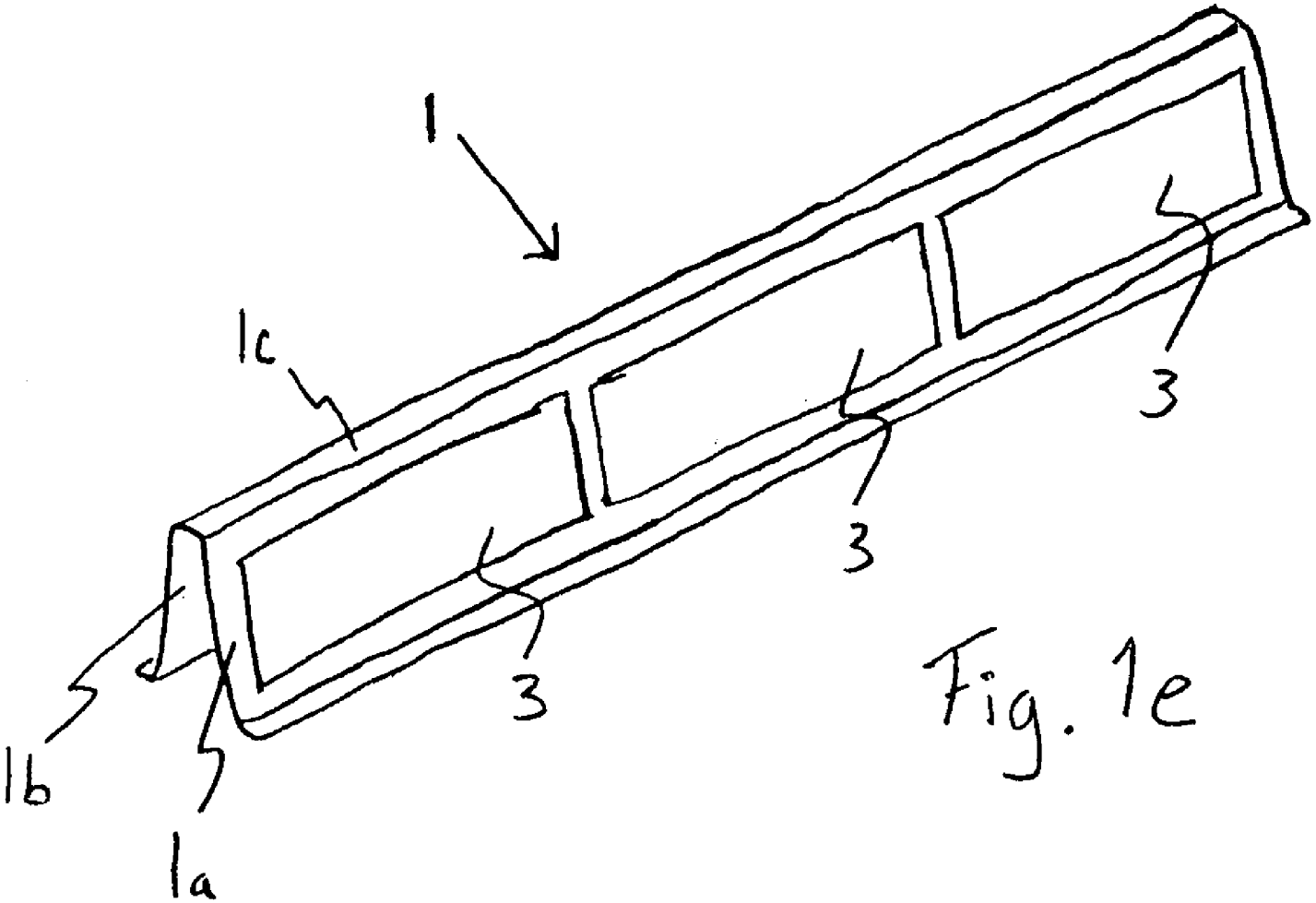

The exemplary embodiment of the invention which is shown in FIG. 1 comprises a fin 1 composed of a multiply bent sheet of aluminum. A flow duct 2, through which a first fluid of the heat exchanger, in this case air, flows in the direction of the arrow A, is formed between two wall faces 1*a*, 1*b* which are inclined with respect to one another. The angle of inclination W3 of the wall faces 1*a*, 1*b* with respect to one another is approximately 14 degrees, with the one wall face 1*a* being inclined by an angle W2 of approximately 12 degrees with respect to one plane E of the heat exchanger, and the other wall face being correspondingly inclined by an angle W3-W2 of approximately 2 degrees (see FIG. 2). The heat exchanger is constructed in such a way that a plurality of the fins 1 are arranged one next to the other so as to form parallel adjacent flow ducts 2. Above and below the fins 1, exchanger tubes or dividing walls (not illustrated) which separate off a second fluid are connected over a surface to the fins 1, in particular soldered over a surface. For this purpose, the fin has a contact region 1*c*.

A flap 3 with an essentially smooth tab face 4, which is inclined in the flow direction A with respect to the side wall 1*a*, is arranged in at least one of the side walls 1*a* of the fin 1. The angle of inclination in the flow direction is approximately 7 degrees.

In each of the four variations of a, b, c, d of the flap 3 which are shown in FIG. 1, the geometric shape is identical. The flap 3 is merely arranged with respectively different orientations in the wall face 1*a*. In the versions a and b, the flap is respectively positioned on the same side with respect to the wall face 1*a*, but the orientation with respect to the direction of the fluid flow A is inverted. The same applies in the versions c and d, with the flap being respectively positioned with an inverted orientation with respect to the wall face 1*a* in relation to the versions a and b.

The tab face 4 has a first straight edge 5 which extends perpendicularly with respect to the flow direction A and at an angle of approximately 12 degrees with respect to the wall face 1*a*.

In the wall face 1*a*, there is a recess which is essentially congruent with the tab face 4 and has a second straight edge 6. The tab face 4 is connected to the wall face 1*a* of the fin here by means of a side wall 7 which has a curved profile. The side wall 7 of the flap 3 is positioned approximately perpendicularly to the wall face 1*a* of the fin 1. In a way which corresponds to the inclination of the tab face 4 in the flow direction A, the height of the side wall 7 increases in the flow direction A. At the end side, a front edge 7*a* of maximum height of the side wall 7 is formed, which front edge 7*a* is located, together with the first edge 5 and the second edge 6, in a plane which is perpendicular with respect to the wall face 1*a*, with the three edges 5, 6 and 7*a* forming a triangular cutout or opening 9 which is positioned perpendicularly with respect to the wall face 1*a*. The triangle 9 has two long sides which are formed by the edges 5 and 6 and which enclose an acute angle W1 of 12 degrees (see FIG. 2) and a short side which is located opposite the acute angle and which is formed by the front edge 7*a* of the side wall 7.

The tab face 7 merges with the wall face 1*a* in a third edge 8 which is approximately parallel to the flow direction, with the third edge forming a bending point by means of which the tab face 4 is bent with respect to the wall thickness 1*a*.

Figure 2:
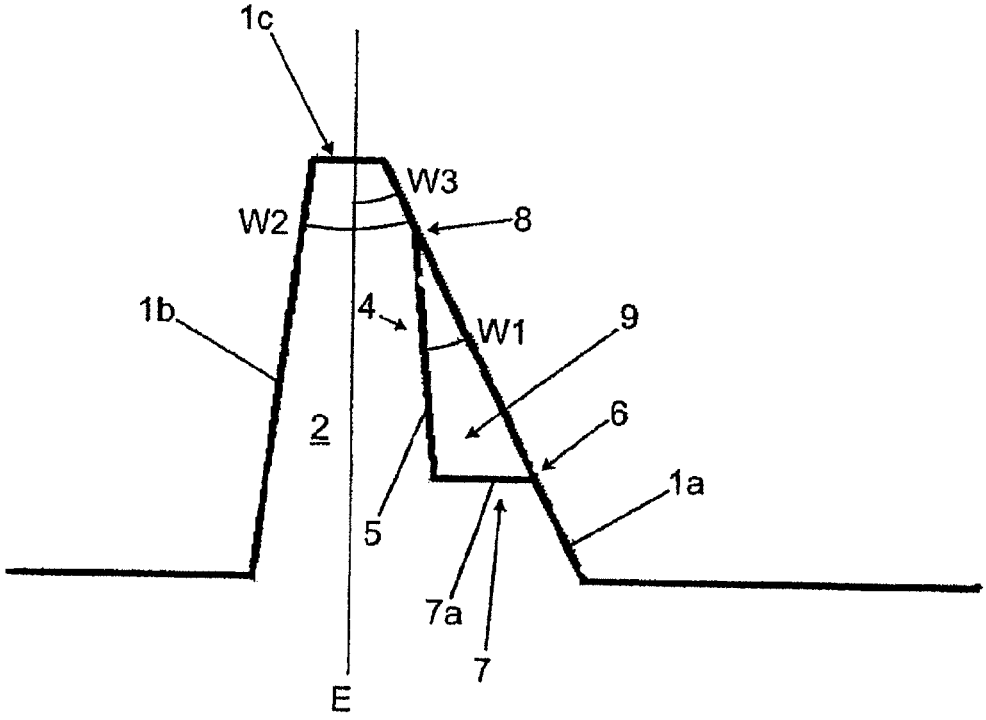
FIG. 2 shows a schematic plan view of the fin from FIG. 1*d* from the front.

The curved side wall 7 firstly has, at its beginning, viewed in the flow direction A according to FIG. 1*a*, a minimum distance from the third edge 8, in the present example a distance of approximately zero, with the distance increasing monotonously over the length L of the tab face. Both at the start of its profile and at the end the side wall has a profile which is almost parallel to the third edge 8.

In a way which corresponds to the gradient of approximately 7°, the length L of the tab face 4 is approximately eight times the maximum height of the side wall 7.

The side wall 7 changes its direction of curvature at approximately half way along its profile, with the result that the curvature has precisely one bending point. Parameterization of the profile of the side walls of the preferred exemplary embodiment is as follows:

[0; 2.500], [0.805; 2.470], [1.610; 2.290], [2.420; 1.910], [3.220; 1.540], [4.030; 1.210], [4.840; 0.980], [5.640; 0.780], [6.440; 0.590], [7.240; 0.400], [8.050; 0.210]

Here, the respective first numeral of a coordinate pair [x; y] represents the distance in the direction of the third edge 8 starting from the first edge 5, that is to say in the direction opposite to the flow direction A. The second numeral y describes, at this point, the perpendicular distance of the side wall 7 from the third edge 8. In these dimensionless relative units, the side wall 7 has a maximum height of approximately 1.0 and the maximum width B of the tab face 4 which extends along the first straight edge and is correspondingly 2.5.

As a result of the scoop-like shaping of the flap as described above, with a tab face 4 which has a double incline and a side wall 7 which rises in the flow direction A, the air which flows through the flow duct 2 and along the wall face 1*a* can pass through the opening 9, in which case it is both eddied and exchanged with an adjacent flow duct. As a result of the rising profile of the tab face 4 and the bent side wall 7, shaping which is particularly effective in terms of flow dynamics is achieved and this gives rise to satisfactory exchange of heat with a low drop in pressure.

Even if the flow direction A is reversed or even with inverted orientation of the flap (see for example FIG. 1*a* in comparison to FIG. 1*b*), a flap according to the invention exhibits good results in this respect. Correspondingly, in a further refined embodiment (not illustrated) there may be provision that a fin has a plurality of flaps 3 in succession, which flaps respectively have different orientations. In particular, in this context the various orientations which are shown in the versions a to d in FIG. 1 can be provided in the same fin. Such a fin could, for example, have a sequence of flaps 3 as follows:

a-b-c-d-a-b-c-d- . . . ; no preferred flow direction a-d-a-d-a-d- . . . ; preferred flow direction Basically, any desired sequences of the orientation of the flaps 3 in a fin according to the invention are possible depending on the requirements and individual optimization.

The fin is manufactured in the present exemplary embodiment from a thin aluminum sheet into which the flaps are first formed by material shaping such as for example deep drawing, and the aluminum sheet is subsequently bent over to form the fin which is shown.

In a further exemplary embodiment of the invention, the fin is formed objectively as in the present exemplary embodiments and is manufactured by means of a longitudinal rolling method. Here, a quasi-endless sheet metal strip composed of aluminium with a thickness of approximately 0.1 mm to approximately 0.15 mm (depending on the requirements it is also possible to use thicker or thinner sheets) is fed in in a feeding direction and shaped to form the fin over a plurality of stations which follow one another in the feeding direction.

Figure 3:
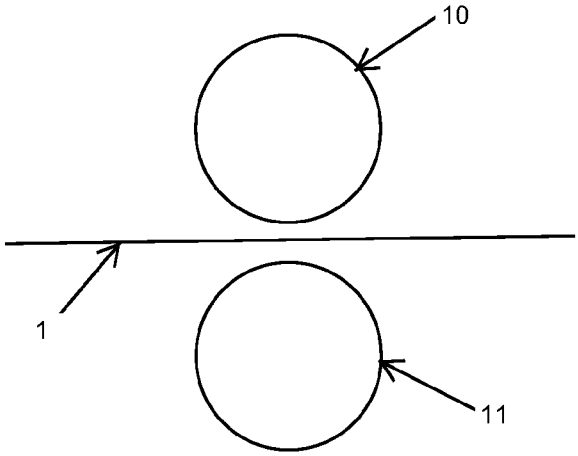
FIG. 3 shows a plan view of two stamping discs of a device for manufacturing a fin according to the invention by means of longitudinal rolling.

FIG. 3 shows one of a plurality of stations, a total of 18 in this case, of a corresponding rolling device. A plan view is shown of two stamping discs 10, 11 which overlap partially in the plan view which is perpendicular to the feeding direction of the sheet metal strip or of the endless fin 1. The sheet metal strip or the fin 1 is already partially folded by the preceding stations of stamping discs or shaping discs, with the result that the flaps 3 are now successively made in the inclined wall faces 1*a* by means of the illustrated stations and the subsequent stations. For this purpose, stamping projections 10*a*, 11*a* are respectively provided in lateral, radically outer regions of the stamping discs 10, 11 and they interact with the inclined wall faces 1*a* and form the desired structures there. The structures are in this case the specially shaped flaps 3 (described in the exemplary embodiments according to FIGS. 1 and 2) which also comprise a cutout in the inclined wall face 1*a*.

With respect to the process of stamping such structures with a severe undercut by means of a longitudinal rolling method, the stamping of the structures is, at least usually, easier, and can take place in fewer steps, the greater the incline of the wall face 1*a* with respect to the perpendicular line of the plane of the fins. In the exemplary embodiment according to FIGS. 1 and 2, approximately 10° has been selected for such an angle W3, which permits the flaps which are shaped in a complex way to be formed. Depending on the requirements and the shape and depth of the structures, the angle can also preferably be between 10° and 20°, in particular between 15° and 20°. Here, a relatively large angle usually means a lower mechanical strength perpendicular to the plane of the fins (for example action as a tie in the case of an internally corrugated fin of a charge air cooler) and a greater degree of geometric limitation of the maximum fold density of the fin. The trade off between the inclination of the wall for the purpose of simplifying the manufacturing process on the one hand and the mechanical properties of the fin on the other is decided by the requirements in an individual case.

After all the shaping stations have been run through, the fins are finished by cutting them to the respectively required length. In this context, fin lengths of any desired size can be selected, which was not possible, or entailed unacceptable costs, when manufacturing, for example, using a lateral rolling method, due to the roller width which was necessary.

Of course, the individual features of the various exemplary embodiments can be appropriately combined with one another depending on the requirements.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A fin for a heat exchanger, comprising:

a fin element extending in a fluid flow direction, the fin element comprising a plurality of wall faces, at least one of which is connected to at least one flap, wherein the at least one flap comprises a flat tab face, and a curved side wall connecting the tab face to the at least one of the wall faces, wherein the tab face is bordered by a first straight tab edge, a curved tab edge, and a second straight tab edge, the first straight tab edge running parallel to the fluid flow direction and being an edge along which the tab face is attached directly to the at least one of the wall faces, wherein the curved side wall is bordered by a first curved side wall edge, a straight side wall edge, and the curved tab edge, the first curved side wall edge being an edge along which the side wall is attached directly to the at least one of the wall faces, wherein the curved tab edge has a first end that is separated from the at least one of the wall faces by the straight side wall edge, and a second end that meets a corresponding second end of the first straight tab edge at a point on the at least one of the wall faces, wherein the second straight tab edge connects the first end of the curved tab edge to a corresponding first end of the first straight tab edge, and wherein an opening is formed by the at least one of the wall faces, the second straight tab edge, and the straight side wall edge.

2. The fin as claimed in claim 1, wherein the second straight tab edge runs perpendicular to the fluid flow direction.

3. The fin as claimed in claim 2, wherein the opening has an essentially triangular shape.

4. The fin as claimed in claim 1, wherein an angle between the at least one of the wall faces comprising the at least one flap, and the second straight tab edge is between 8 and 16 degrees.

5. The fin as claimed in claim 1, wherein a length of the first straight tab edge is between two and four times larger than a length of the second straight tab edge.

6. The fin as claimed in claim 1, wherein the curved tab edge has approximately a shape of a sigmoid curve.

7. The fin as claimed in claim 1, wherein a width of the tab face decreases from a first end of the tab face to a second end of the tab face.

8. The fin as claimed in claim 1, wherein a curvature of the side wall has, in its profile, at least one turning point with respect to a direction of curvature.

9. The fin as claimed in claim 1, wherein an inclination of the tab face with respect to the wall face in the fluid flow direction is between 5 and 10 degrees.

10. The fin as claimed in claim 1, wherein the at least one flap is a plurality of flaps in succession in the fluid flow direction.

11. The fin as claimed in claim 10, wherein at least one of the plurality of flaps is arranged with a reversed orientation with respect to another one of the plurality of flaps.

12. The fin as claimed in claim 10, wherein at least two of the plurality of flaps are connected to the at least one of the wall faces and having different opening directions with respect to the wall face.

13. The fin as claimed in claim 1, further comprising:

a flat contact region configured to contact an exchanger tube or dividing wall, wherein the at least one of the wall faces connected to the at least one flap is attached to a side of the flat contact region and inclined at an angle between 2 and 45 degrees with respect to a plane defined by (i) a line in the fluid flow direction and (ii) a line perpendicular to a plane of the flat contact region.

14. The fin as claimed in claim 13, wherein the at least one of the wall faces comprising the at least one flap is inclined at an angle between 15 and 20 degrees with respect to the plane defined by (i) the line in the fluid flow direction and (ii) the line perpendicular to the flat wall face.

15. The fin as claimed in claim 13, wherein the fin is composed of sheet metal with a thickness between 0.05 mm and 0.35 mm.

16. The fin as claimed in claim 1, wherein the fin is embodied as an internally corrugated fin of a charge air cooler.

17. A heat exchanger having at least one fin as claimed in claim 1.

18. The heat exchanger as claimed in claim 17, wherein the heat exchanger is a heat exchanger for a motor vehicle.

* * * * *